United States Patent [19]

Suzuki et al.

[11] Patent Number: 5,005,533

[45] Date of Patent: Apr. 9, 1991

[54] TWO CYCLE ENGINE WITH FUEL INJECTOR

[75] Inventors: Kazuo Suzuki; Fusao Tachibana; Mitsugi Chonan, all of Tokyo, Japan

[73] Assignee: Fuji Jukogyo Kabushiki Kaisha, Tokyo, Japan

[21] Appl. No.: 442,069

[22] Filed: Nov. 28, 1989

[30] Foreign Application Priority Data

Dec. 9, 1988 [JP] Japan ..... 63-160550[U]

[51] Int. Cl.[5] ..... F02M 35/10

[52] U.S. Cl. ..... 123/52 MB; 123/73 A

[58] Field of Search ..... 123/52 M, 52 MV, 52 MC, 123/52 MB, 73 A, 73 V

[56] References Cited

U.S. PATENT DOCUMENTS

| | | | |
|---|---|---|---|
| 4,502,435 | 3/1985 | Tadokoro et al. | 123/52 MB |
| 4,520,775 | 6/1985 | Nakamura | 123/52 M |
| 4,840,146 | 6/1989 | Yanagisawa et al. | 123/52 MC |

FOREIGN PATENT DOCUMENTS

| | | | |
|---|---|---|---|
| 0017418 | 2/1979 | Japan | 123/52 MB |
| 0137516 | 10/1979 | Japan | 123/52 MB |
| 0150512 | 11/1979 | Japan | 123/52 MB |
| 0052651 | 3/1982 | Japan | 123/52 MB |
| 0155220 | 9/1983 | Japan | 123/52 MB |
| 0306252 | 12/1988 | Japan | 123/52 MB |

*Primary Examiner*—David A. Okonsky

*Attorney, Agent, or Firm*—Beveridge, DeGrandi & Weilacher

[57] ABSTRACT

A two-cycle engine with fuel injector comprises an engine body, a crank case defining crank chambers for respective cylinders, the crank chambers being provided with intake ports, throttle bodies, and fuel injectors. The throttle bodies comprise throttle passages and throttle valve means and the injectors are inserted in the throttle passages downstream of the throttle valve means. The throttle passages are connected to each other through a balance passage at portions downstream the throttle valve means. An air chamber may be formed on the way of the balance passage. The throttle passages connected by the balance passage to one group of cylinders having phase difference of 180° of the reciprocating stroke.

3 Claims, 6 Drawing Sheets

TWO CYCLE ENGINE WITH FUEL INJECTOR

BACKGROUND OF THE INVENTION

The present invention relates to a two-cycle engine with fuel injector capable of uniformly distributing induced air into multiple cylinders of the engine.

Recently, there is proposed a two-cycle engine with fuel injectors for improving the response during low or medium speed operation of the engine as well as high speed operation and, for improving the control of an exhaust gas emission.

For example, the Japanese Utility Model Laid-open Publication No. 58-169117 discloses a two-cycle engine with fuel injector in which fuel injection amount is determined with parameters of an intake air amount and an engine speed, and the fuel is injected from the injector with a predetermined timing.

In a two-cycle engine having two cylinders, for example, two fuel injection operate simultaneously for the respective cylinders per one revolution of the engine. The fuel is injected from the injectors of all cylinders in accordance with the intake timings of the respective cylinders. Accordingly, an air intake timing for one cylinder is not necessarily appropriate to the fuel injection timing for the other cylinder (for example, the fuel injection of the second cylinder at a crank angle of 0°).

The fuel injected at a position which does not correspond to the intake timing reversely flows to the upstream side of a throttle valve when it is blown back from the cylinder. During the high or intermediate speed of the engine, the air intake inertia effect is so high that the reverse flow has less effect. However, an air cleaner element is contaminated by the blow back of the gas during the low speed operation. In addition, it is necessary to supply the additional fuel which adheres to the air cleaner element and the inner wall of the intake passage. Accordingly, the fuel efficiency becomes worse. Furthermore, the mixtures for the respective cylinders will be unevenly distributed, which results in decreasing efficiency of the exhaust emission control, the output and the acceleration performance of the engine.

SUMMARY OF THE INVENTION

An object of the present invention is to eliminate the defects or drawbacks in the prior art described above and to provide a two-cycle engine with fuel injection for uniformly distributing the mixture into the respective cylinders and for improving the engine output efficiency and the acceleration performance of the engine.

Another object of this invention is to provide a two-cycle engine with fuel injection for preventing the contamination of the air cleaner element, for example, and improving the control of the exhaust gas emission These and other objects can be achieved according to the present invention by providing a two-cycle engine with fuel injector comprising a crank case, intake ports, throttle bodies, fuel injectors provided in the throttle valves, the throttle bodies comprising throttle passages respectively connected to the intake ports, and a balance passage connecting the throttle passages at downstream of the throttle valve, respectively.

In a preferred embodiment, an air chamber is formed in the balance passage. The throttle passages connected with the balance passage to one group of cylinders having a phase difference of 180° may be communicated with each other.

According to the two-cycle engine described above, the downstream sides of the throttle valves located in the respective throttle passages are connected to each other through the balance passage, so that the reversely flowing gas caused in one cylinder flows into another cylinder at the intake timing through the balance passage. Accordingly, the distribution of the mixture on the downstream side of the throttle valve becomes uniform and the reverse-flow of the mixture towards the upstream side can be substantially eliminated. The air chamber in the balance passage attenuates the pulsation of the mixture flow, whereby the engine output and the acceleration performance may be improved. In addition, the reverse-flow caused in one cylinder is fed to another cylinder by connecting the throttle passages of one group of cylinders having a phase difference of 180° through the balance passage at the air intake timing. The air-fuel ratio can be improved as well as the fuel consumption and exhaust emission efficiencies.

DESCRIPTION OF THE PREFERRED EMBODIMENT

A preferred embodiment of the present invention will become understood from the following detailed description referring to the accompanying drawings.

For better understanding of the background of this invention, the basic principle of the conventional two-cycle engine with two-cylinder is first described hereinafter with reference to FIG. 6.

Figure 6:
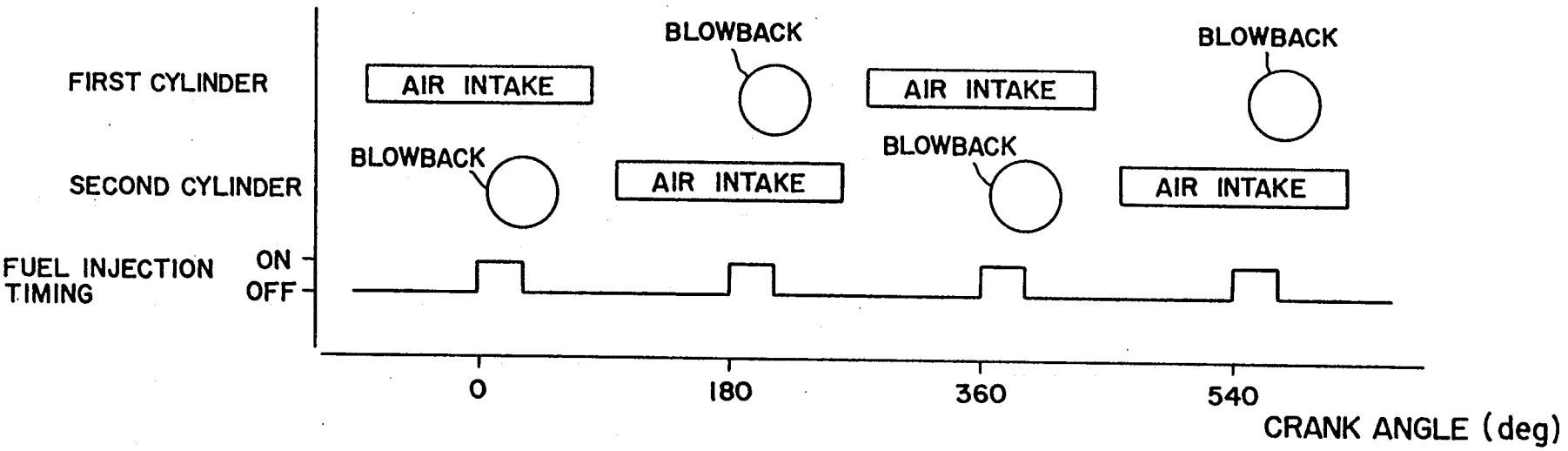
FIG. 6 PRIOR ART
FIG. 6 shows a time chart representing simultaneous injections with phase difference of 180°.

Referring to FIG. 6, a horizontal axis represents a crank angle of an engine and a vertical axis represents intake timings and fuel injection timings of the respective cylinders of the two-cycle engine with two cylinders. In this type of the engine, two fuel injections are simultaneously performed with respect to the respective cylinders by every one revolution of the engine. The fuel is injected from the injectors of all cylinders in accordance with the air intake timings of the respective cylinders. Accordingly, there causes a case where the intake timing is not in accordance with the fuel injection timing (for example, the fuel injection of the second cylinder at a crank angle of 0°).

The fuel injected at a position which does not correspond to the intake timing flows reversely to the upstream side of a throttle valve because of blowback from the cylinder, such a position is indicated by circles in FIG. 6. In such a case, defects and drawbacks described hereinbefore are caused An embodiment of the present invention conceived to substantially eliminate these defects or drawbacks encountered to the prior art will be described hereunder with reference to FIGS. 1 to 5.

Figure 5:
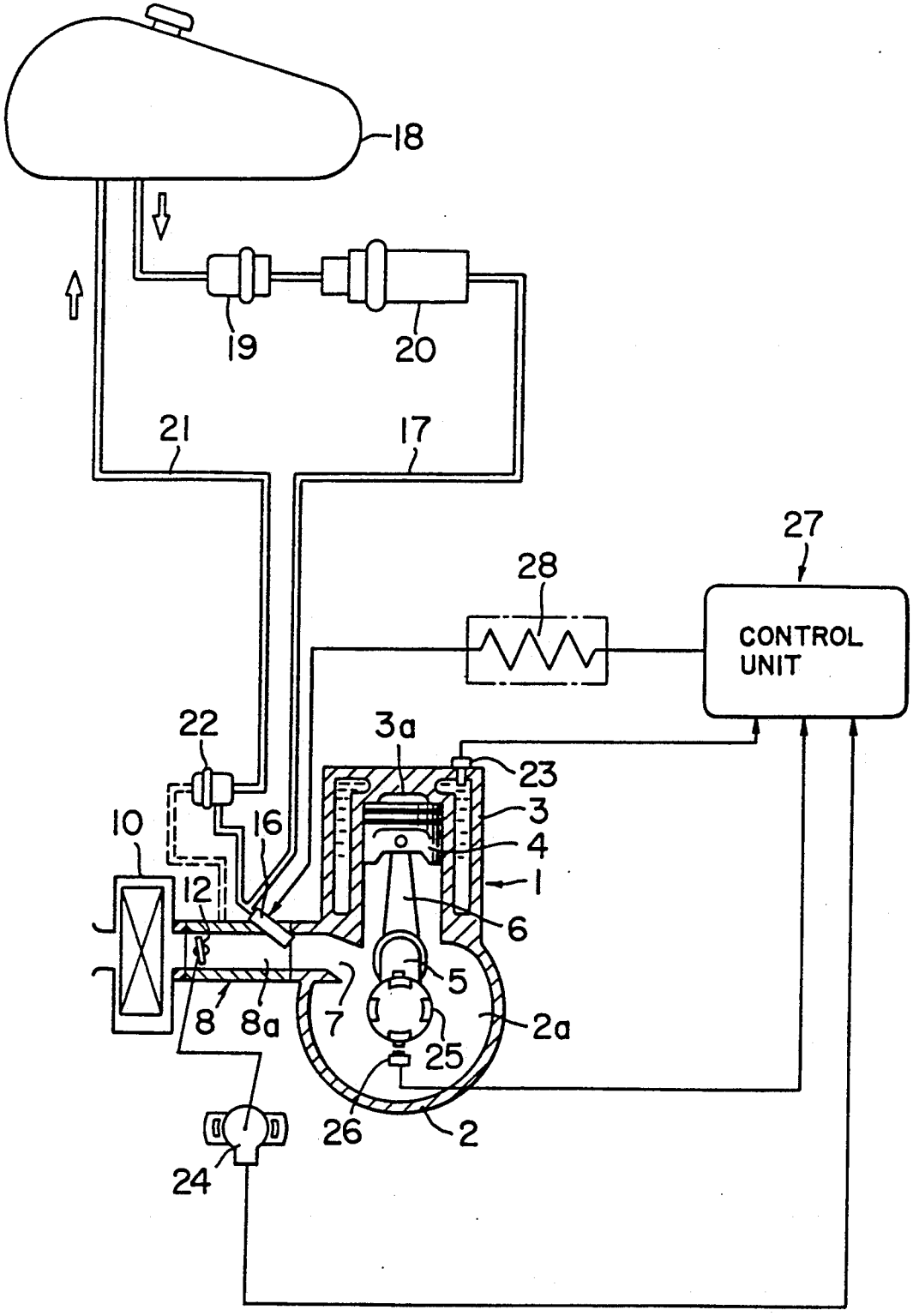
FIG. 5 is a block diagram showing an arrangement of a control system for the fuel injection.

Referring to FIGS. 1 to 5, particularly as best shown in FIG. 5, an engine body 1 of a two-cycle engine with two cylinders is provided with a crank case 2. The crank case 2 is provided with a number of crank chambers 2a corresponding to the numbers of the cylinders. A cylinder block 3 is disposed in the crank case 2, and one group of pistons 4 are inserted in the cylinders. A combustion chamber 3a above the pistons 4 is formed in the cylinder block 3. The combustion chamber 3a communicates with the crank chamber 2a through a scavenging passage, not shown. The pistons 4 are connected through connecting rods 6 to a crank shaft 5 horizontally extending in the crank chamber 2a.

When the pistons 4 are reciprocated, an exhaust port and a scavenge port are opened. At the next step an intake port 7 communicating with the crank chamber 2a is opened for a predetermined time for example, a lead valve or a rotary valve is installed at the intake port.

In the two-cycle engine, the respective pistons 4 are connected to the crank shaft 5 so as to be rotated with difference in phase by 180°. Accordingly, when the piston in one cylinder is in up stroke, the piston in the other cylinder is in down stroke.

Each downstream end of one group of throttle bodies 8 is connected to the open end of the intake port 7 through a rubber mount 9. The upstream end of the throttle body 8 is coupled to an air cleaner 10. The intake port 7 and the air cleaner 10 are connected through a throttle passage 8a of the throttle body 8.

Figure 1:
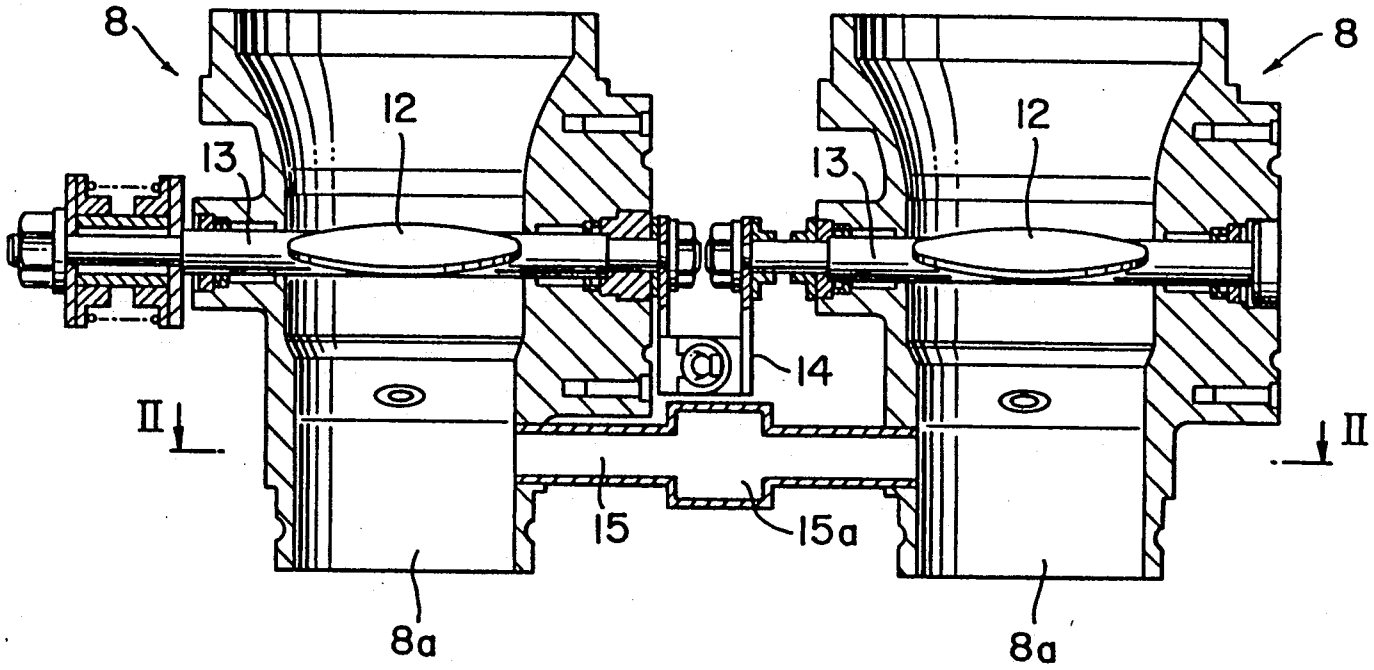
FIG. 1 is an elevational section of throttle bodies of a two-cycle engine with two cylinders according to this invention.
Figure 2:
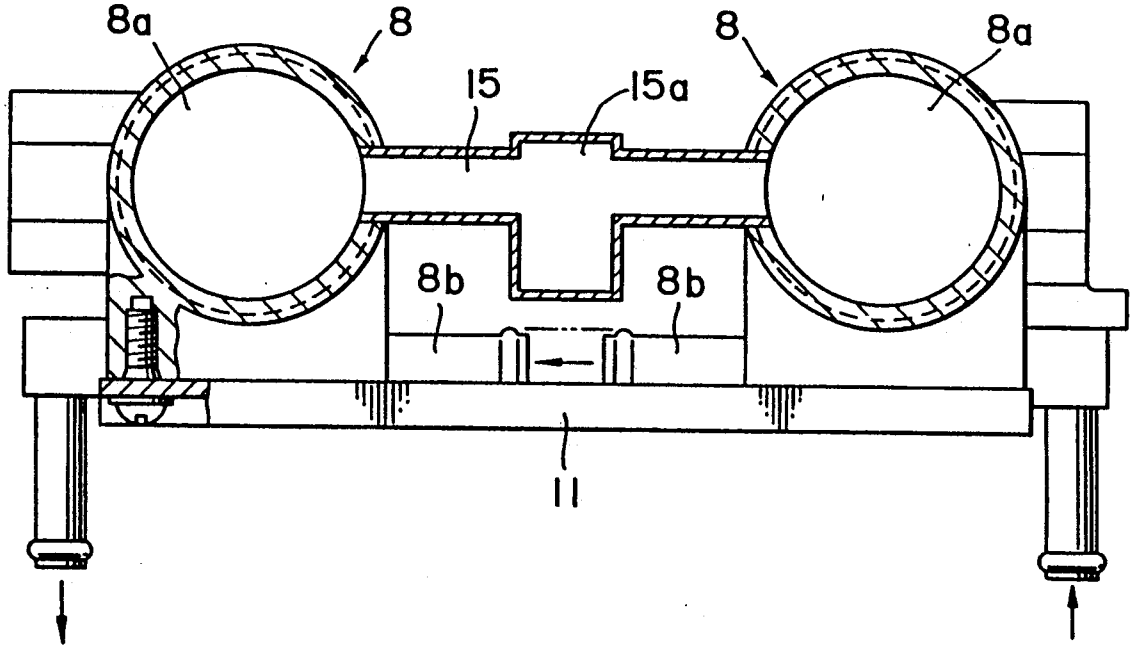
FIG. 2 is a sectional view taken along the line II—II shown in FIG. 1.
Figure 3:
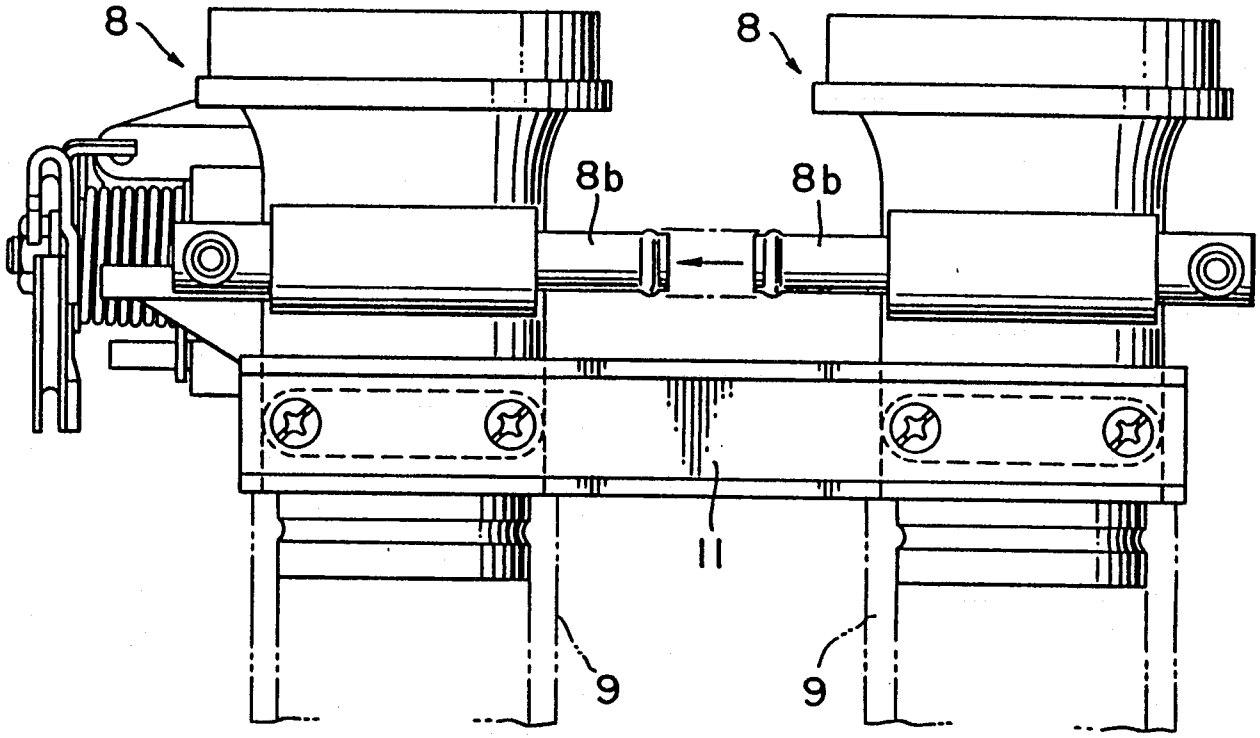
FIG. 3 is a front view of the throttle bodies shown in FIG. 1.
Figure 4:
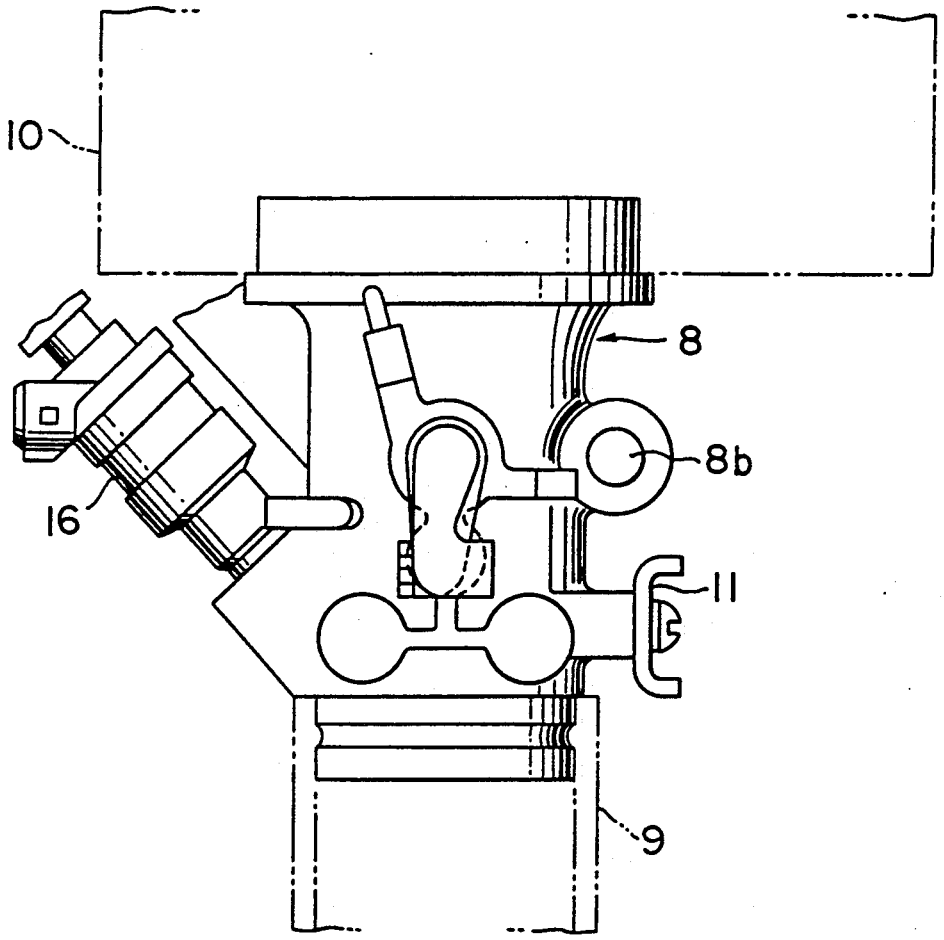
FIG. 4 is a lefthand side view of the throttle bodies of FIG. 3.

The respective throttle bodies 8 are connected each other through a bracket 11, as shown in FIG. 2, and secured to the engine body 1.

A throttle valve 12 is mounted to each throttle passage 8a of the throttle body 8 and a throttle shaft 13 for fixedly supporting the throttle valve 12 is coupled through a link 14.

The downstream ends of the respective throttle valves 12 are connected each other through a balance passage 15, and an air chamber 15a is formed in the passage 15.

The throttle body 8 is provided with a hot water passage 8b for preventing an icing phenomenon.

Injectors 16 are inserted in the respective throttle passages 8a at downstream sides of the throttle valves 12. The respective injectors 16 are communicated each other through delivery pipes, not shown. One of the injectors 16 is communicated with a fuel tank 18 through a fuel feed passage 17, in which a fuel filter 19 and a fuel pump 20 are provided as shown in FIG. 5.

The injector 16 is also connected to the fuel tank 18 through a fuel return passage 21, and a pressure regulator 22 for adjusting a fuel pressure by detecting a negative pressure on the downstream side of the throttle valve 12.

A coolant temperature sensor 23 is inserted in a coolant passage of the engine body 1. A throttle sensor 24 is connected to the throttle valve 12. An engine speed sensor 26 is provided at a position opposite to a rotor 25 mounted on the crank shaft 5. These sensors 23, 24 and 26 are connected to the input side of a control unit 27, respectively, and the output side of the control unit 27 is connected to an excitating coil (not shown) of the injector 16 through a dropping resistor 28.

The operation of the engine of this type will be described hereinafter.

FUEL INJECTION CONTROL

When the engine is started the control unit 27 calculates the engine speed N, an opening degree $\theta$TH of the throttle valve 12 and a coolant temperature Tw from the respective sensors 23, 24 and 26.

At the next step, an intake air amount Qpre is assumed with a function of the engine speed N and the throttle valve opening degree $\theta$TH (Qpre=f(N, $\theta$TH)). The intake air amount Qpre is calculated by referring a map with the parameters of the engine speed N and the throttle valve opening degree $\theta$TH.

The basic fuel injection amount is determined on the basis of the intake air amount Qpre and the engine speed N as $Tp=K\times Qpre/N$ (K: constant).

In the meantime, on the basis of the coolant temperature Tw and the throttle valve opening degree $\theta$TH, various coefficients COFF for correcting the amounts in dependency on the coolant temperature and increased amount of fuel after idling state are determined.

Thereafter, the fuel injection amount Ti is determined by correcting the basic fuel injection amount Tp by the coefficients COFF and a voltage correcting coefficient Ts set by a battery voltage, and thus, the corrected fuel injection amount Ti is expressed as $Ti=Tp\times COFF+Ts$.

Pulse signals for operating the fuel injectors 16 are then transmitted to the exciting coils of the injectors 16 for the respective cylinders at the predetermined timings as represented by FIG. 6.

ENGINE OPERATION

When the engine starts and the piston 4 is now in the upward stroke, the intake air is induced into the crank chamber 2a from the air cleaner 10 through the throttle passage 8a and the intake port 7 by the negative pressure in the crank chamber 2a.

When the piston 4 begins downward stroke, the exhaust port is first opened to exhaust the combustion gas, and the scavenge port is next opened to induce the mixture in the crank chamber 2a into the combustion chamber 2 to scavenge the inside thereof.

During the downward stroke, the mixture in the crank chamber 2 is compressed, but the time lag exists for closing the lead valve installed at the intake port 7 or for closing the rotary valve. Accordingly, a part of the mixture flows back towards the intake port 7, i.e. this phenomenon is called "blowback" phenomenon.

Since the respective cylinders are arranged with the phase difference of 180°, one cylinder is in the upward stroke and the other one is in the downward stroke and hence, the intake timings are alternatively caused with respect to the respective cylinders.

Accordingly, the reverse-flow gas generated in one cylinder will be fed to the other cylinder at the intake timing through the balance passage 15. The pulsation of this reverse-flow gas will be attenuated by the air chamber 15a disposed in the balance passage 15. Therefore, the fuel distribution to the respective cylinders becomes equalized, whereby the engine output and the acceleration performance may be remarkably improved. Moreover, the reverse-flow gas from one cylinder may be burnt in the other cylinder, so that the fuel consumption may also be improved. The blowback into the air cleaner may be eliminated and the contamination of the air cleaner element may be consequently eliminated.

It is to be noted that the present invention is not limited to the described embodiment and many other changes and modifications may be made without departing from the scope of the appended claim.

For example, this invention may be applied to the engine provided with an odd number of cylinders (three or more than three). In this case, the throttle passages for the respective cylinders may be connected in series through the balance passages to uniformly distribute the air fuel mixture to the respective cylinders. With respect to the even number of cylinders (four or more than four), adjacent cylinders having phase difference of 180° may be connected through the balance passages.

While the presently preferred embodiments of the present invention have been shown and described, it is to be understood that these disclosures are for the purpose of illustration and that various changes and modifications may be made without departing from the scope of the invention as set forth in the appended claims.

We claim:

1. A two-cycle engine with fuel injector, having an engine body with at least two cylinders, a crank case defining crank chambers operatively communicating with the corresponding cylinders, a plurality of throttle bodies, throttle passages connected to the corresponding crank chambers, each of said throttle bodies having mounted therein a throttle valve at a position upstream of the throttle passage, respectively, and said throttle passage communication with the outside of the engine through at least one air cleaner, and a fuel injector provided at a position downstream of the throttle valve, respectively, comprising:

a balance passage located between and connecting the throttle passages with each other whereby a reverse flow mixture flowed back from one of the cylinders can be supplied to the other of the cylinders through the balance passage, an air chamber formed in said balance passage for attenuating pulsation of the reverse flow mixture.

2. The two-cycle engine according to claim 1, wherein the cylinders have a phase difference of 180° of stroke from each other.

3. The two-cycle engine according to claim 1, wherein said balance passage has only two opposite ends and only connects the throttle passages with each other.

* * * * *